US007104730B2

(12) United States Patent
Leverette et al.

(10) Patent No.: US 7,104,730 B2
(45) Date of Patent: Sep. 12, 2006

(54) ACHIEVING HYDROSTATIC STABILITY OF A FLOATING STRUCTURE

(75) Inventors: Steven J. Leverette, Richmond, TX (US); Steven E. Kibbee, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 10/492,074

(22) PCT Filed: Oct. 9, 2002

(86) PCT No.: PCT/US02/32461

§ 371 (c)(1),
(2), (4) Date: Jul. 14, 2004

(87) PCT Pub. No.: WO03/031255

PCT Pub. Date: Apr. 17, 2003

(65) Prior Publication Data

US 2005/0013669 A1 Jan. 20, 2005

Related U.S. Application Data

(60) Provisional application No. 60/327,945, filed on Oct. 9, 2001.

(51) Int. Cl.
*B63B 21/50* (2006.01)

(52) U.S. Cl. ..... 405/200; 405/223.1; 114/266; 114/264

(58) Field of Classification Search ..... 405/195.1, 405/196, 200, 223.1, 224; 114/264–266
See application file for complete search history.

(56) References Cited

U.S. PATENT DOCUMENTS

| | | | | |
|---|---|---|---|---|
| 3,955,521 | A | 5/1976 | Mott | |
| 3,983,706 | A | 10/1976 | Kalinowski | |
| 3,996,754 | A | 12/1976 | Lowery | |
| 4,007,598 | A * | 2/1977 | Tax | 405/200 |
| 5,567,086 | A * | 10/1996 | Huete | 405/223.1 |
| 5,980,159 | A * | 11/1999 | Kazim | 405/200 |
| 6,241,425 | B1 * | 6/2001 | Kazim | 405/200 |
| 6,435,773 | B1 | 8/2002 | Khachaturian | |
| 6,688,250 | B1 * | 2/2004 | Davies et al. | 114/264 |
| 6,830,413 | B1 * | 12/2004 | Wybro et al. | 405/195.1 |

* cited by examiner

*Primary Examiner*—Frederick L. Lagman
(74) *Attorney, Agent, or Firm*—Nick A. Nichols, Jr.

(57) ABSTRACT

A floating platform includes a hull and a deck mounted on the uppermost end of the hull. The platform is anchored to the seabed by a plurality of tendons connected to the hull at the upper ends thereof and secured to the seabed at the lower ends thereof. The platform includes detachable buoyancy means providing supplemental buoyancy for hydrostatically stabilizing the platform without utilizing a derrick barge while ballasting the platform during installation.

15 Claims, 5 Drawing Sheets

10
12
13
14
16
18
22
28
34
38
40
42
44

10
12
13
14
16
18
20
22
28
34
38
40
42
44

ACHIEVING HYDROSTATIC STABILITY OF A FLOATING STRUCTURE

The application is a national stage entry of PCT/US02/32461 filed Oct. 9, 2002, which claims benefit from provisional application 60/327,945 filed Oct. 9, 2001.

BACKGROUND OF THE DISCLOSURE

The present invention relates generally to floating platform systems for testing and producing hydrocarbon formations found in offshore waters. More particularly, the invention relates to a method and system for achieving hydrostatic stability of a floating structure while ballasting during installation of the structure.

The exploration for oil and gas deposits in offshore waters, and recovery of the oil and gas therefrom is very expensive. Various methods and offshore production systems have been utilized to locate and recover offshore oil and gas deposits. Exploration and production systems such as converted Mobile Offshore Drilling Units ("MODU"), Tendon Leg Platforms (TLP) and other floating structures typically used in offshore waters are very expensive to manufacture and install.

Installation of an offshore platform, such as a TLP, may require that the platform hull be wet towed to the installation site. The hull of a single column TLP comprises the central column and a plurality of pontoons extending radially outwardly from the central column. The hull of a single column TLP is quite stable floating on the pontoons because of the large water plane area provided by the central column and pontoons. During installation, the hull is ballasted down for connection to a plurality of tendons which anchor the hull to the seabed. As the hull is ballasted down, the hydrostatic stability of the hull decreases significantly after the pontoons submerge. To reduce stability problems during installation, the hull is typically installed without the deck and with a stabilizing upward force applied at the top of the hull as it is ballasted down to connect with the pre-installed tendons. This stabilizing force is typically supplied by a derrick barge. After the hull is lowered, connected to tendons and deballasted, the system is very stable. The deck may then be lifted using the derrick barge and safely set on the platform hull.

For some offshore platform installations, it may be very advantageous commercially to utilize an installation alternative that eliminates the need for the expensive derrick barge during hull and deck installation. One such installation method, would for example, include installing the deck on the hull in a less exposed, shallower water location with less expensive lifting means, wet-towing the hull-deck assembly to the installation site, and safely lowering the hull-deck assembly and connecting it to pre-installed tendons without using a derrick barge.

It is therefore an object of the present invention to provide a method of installing an offshore floating platform without using a derrick barge.

It is a further object of the present invention to provide a method of installing a floating platform including the steps of assembling the complete hull, deck and most production equipment at or near the fabrication site; wet towing the assembled platform to the installation site; and ballasting down the assembled platform to tendon connection draft without a derrick barge.

It is a further object of the present invention to provide a method of installing a floating platform by providing hydrostatic stability for the hull of the platform at all drafts through the use of supplemental buoyancy.

SUMMARY OF THE INVENTION

In accordance with a preferred embodiment of the present invention, a floating platform includes a hull and a deck mounted on the uppermost end of the hull. A plurality of pontoons extend radially outwardly from the lower end of the hull. The platform is anchored to the seabed by a plurality of tendons connected to the hull at the upper ends thereof and secured to the seabed at the lower ends thereof. The platform includes detachable ballast means providing supplemental buoyancy for hydrostatically stabilizing the platform without utilizing a derrick barge while ballasting the platform during installation.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
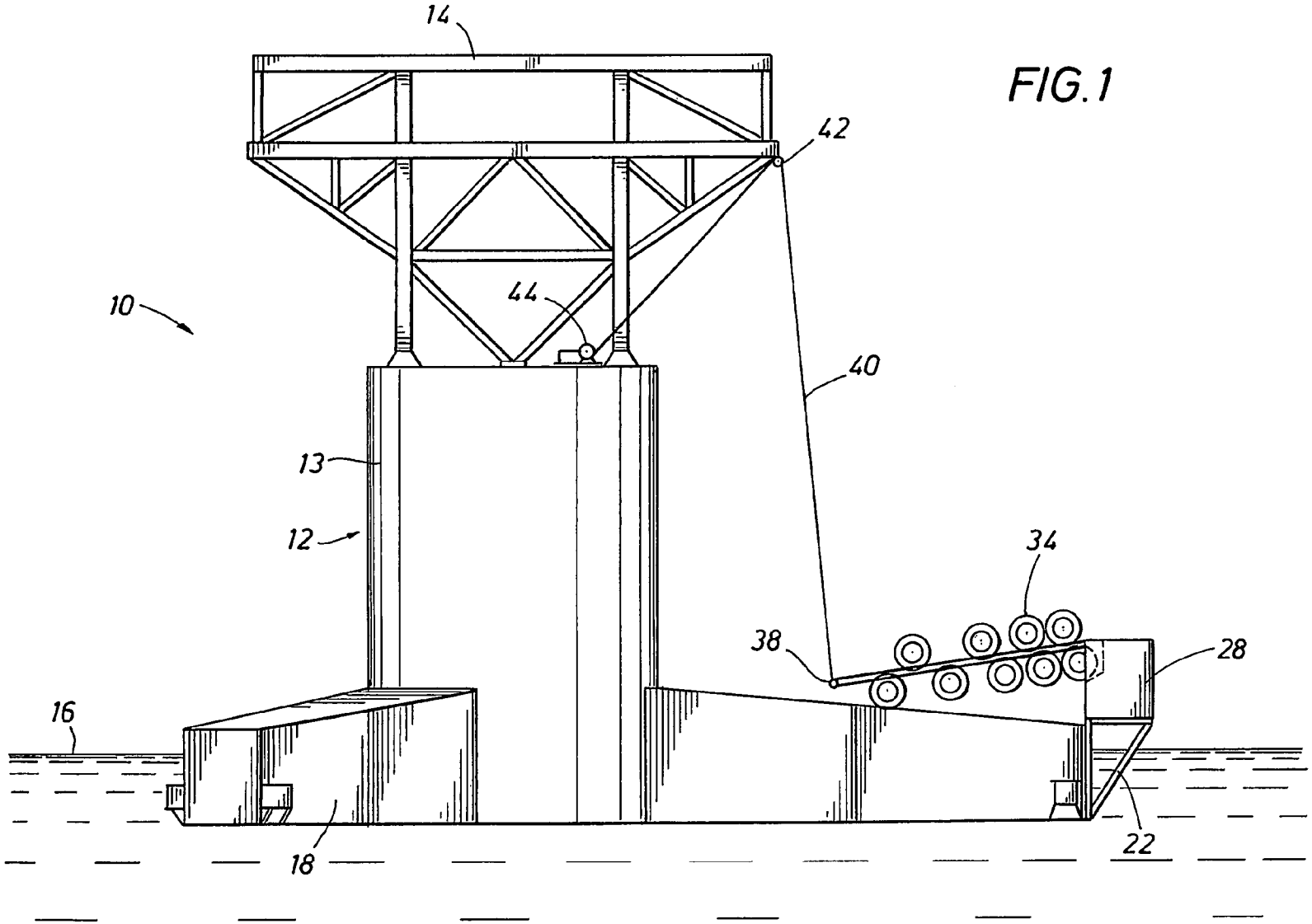
FIG. 1 is a side view of the floating platform of the invention illustrating the platform being wet towed to the installation site.

Referring first to FIG. 1, the floating platform of the invention is generally identified by the reference numeral 10. The platform 10 includes a hull 12 which provides positive buoyancy and vertical support for the platform 10. The hull 12 comprises a central column 13 and pontoons 18 extending radially outwardly from the lower end of the central column 13. One or more decks 14 are supported on the central column 13 above the water surface 16. Drilling and/or production equipment necessary for the recovery and processing of oil, gas and water recovered from the oil and gas field are secured on the deck 14.

Figure 3:
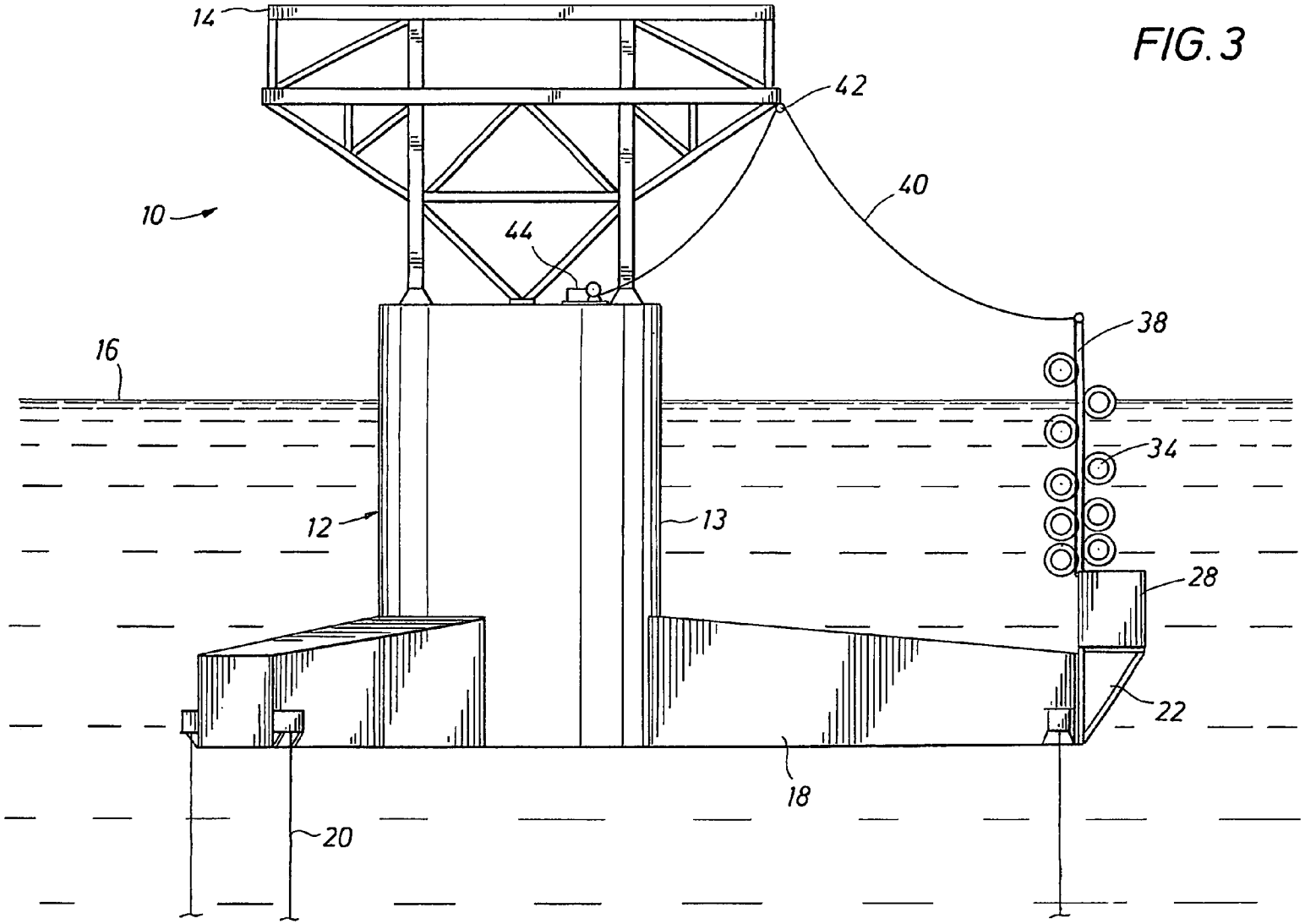
FIG. 3 is a side view of the floating platform of the invention illustrating the platform at full installation draft and full deployment of the detachable ballast means providing supplemental buoyancy.

The central column 13 extends upward from the base or keel of the platform 10. The base node of the platform 10 is at the intersection of the central column 13 and the pontoons 18 extending radially outwardly therefrom. The platform 10 is anchored to the seabed by tendons 20 secured at one end thereof to the pontoons 18, as shown in FIG. 3, and at the opposite ends thereof to foundation piles (not shown in the drawings) embedded in the seabed. The hull 12 provides sufficient buoyancy to support the payload of the platform 10; which payload includes the deck 14, drilling and/or completion equipment, production facilities, production and drilling risers; and sufficient excess buoyancy to develop the tendon pre-tension.

Referring still to FIG. 1, the hull 12, including the deck 14 mounted on top of the central column 13, is towed to the installation site and maneuvered over tendons 20 which have been pre-installed and connected at the lower ends thereof to foundation piles embedded in the seabed. In the configuration shown in FIG. 1, the hull 12 and deck 14 mounted thereon are stable floating on the pontoons 18 because of the large water plane area provided by the pontoons 18. The assembled hull 12 and deck 14, however, is unstable at drafts where the pontoons 18 are fully submerged below the water line 16. At full installation draft, the assembled hull 12 and deck 14 may be unstable until the tendons 20 are connected to the pontoons 18. In the final installed configuration of the platform 10, the tendons 20 provide stability.

Figure 2:
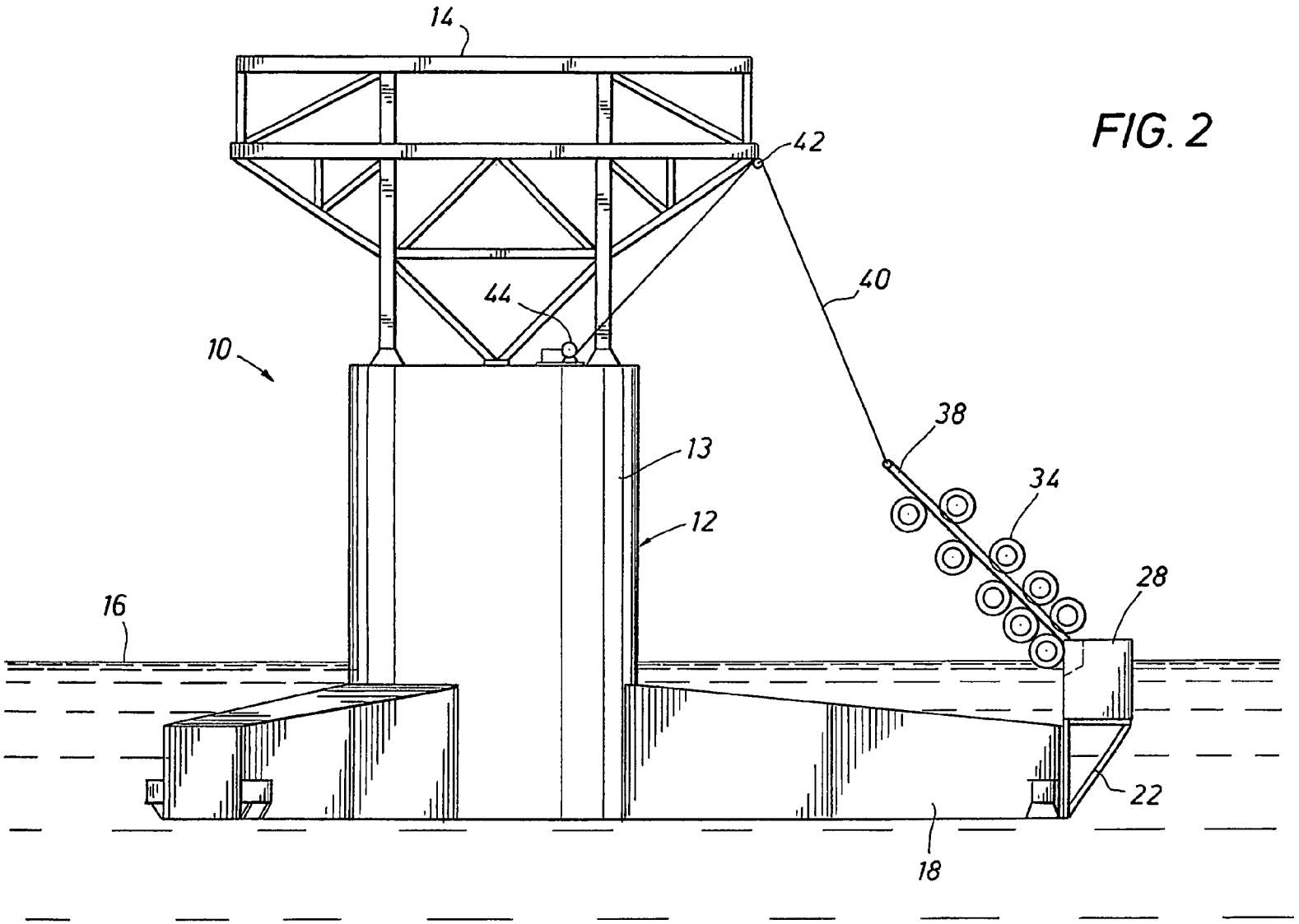
FIG. 2 is a side view of the floating platform of the invention illustrating ballasting the platform and depicting the pontoons submerged below the water line.

Referring now to FIGS. 2 and 3, upon positioning the platform 10 over the tendons 20, it is ballasted down for connection to the upper ends of the tendons 20. The hydrostatic stability of the platform 10 is maintained by supplemental buoyancy added to the ends of the pontoons 18 to provide additional water plane area and righting moment. For the sake of convenience, only one secondary buoyancy assembly is shown mounted on the pontoons 18. It is understood however that the platform 10 of the inventions includes a secondary or supplemental buoyancy assembly mounted to the distal ends of each of the pontoons 18.

The secondary buoyancy assembly includes a transition structure 22 releasably connected to the distal ends of the pontoons 18. Any number of releasable connection means may be utilized to securely mount the transition structure 22 to the pontoons 18. In a preferred embodiment shown in FIG. 4, brackets 24 provided on the pontoons 18 are adapted for mating engagement with padeyes 26 provided on the transition structure 22. A connector pin 23 inserted through the aligned brackets 24 and padeyes 26 fixedly secures the transition structures 22 to the distal ends of the pontoons 18.

The secondary buoyancy assembly further includes a floodable hard tank 28 welded or otherwise mounted on top of the transition structure 22. The hard tank 28 is provided with the necessary plumbing, including a fill port 30 and vent 32, for connection with the ballast system of the marine installation equipment.

Figures 4, 5:
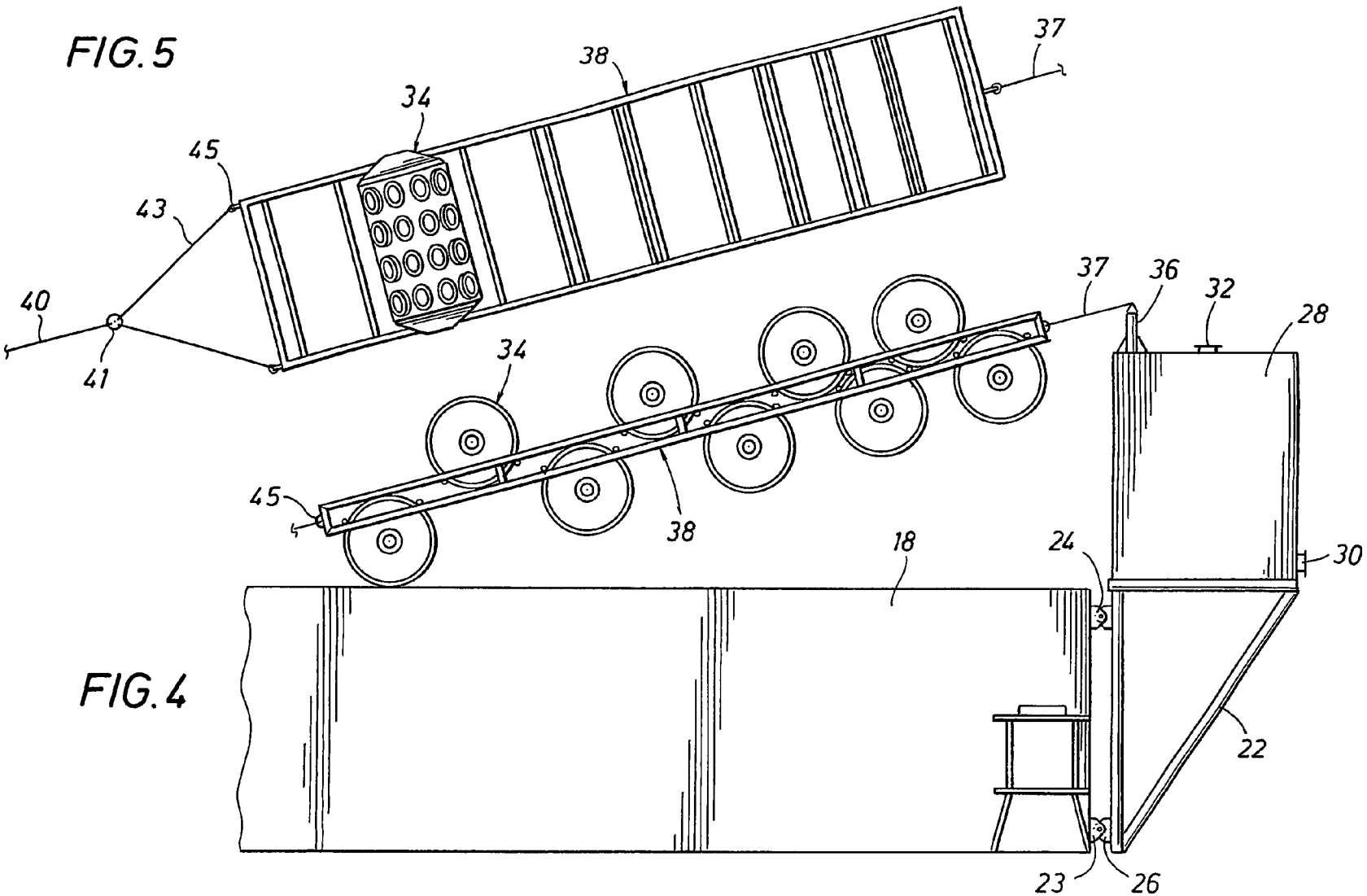
FIG. 4 is a partial exploded view of the detachable ballast means of the invention.
FIG. 5 is top plan view of the buoy support frame of the detachable ballast means of the invention.

Referring still to FIGS. 4 and 5, an assembly of buoys 34 is pivotally connected to a buoy support post 36 secured to top of the hard tank 28. The buoys 34 are assembled on a buoy support frame 38 secured to the support post 36. As the pontoons 18 submerge, the buoys 34 are drawn into the water to provide the additional water plane area for maintaining the hydrostatic stability of the platform 10 as it is ballasted down for connection to the tendons 20. Commercially available buoyancy elements, such as Yokohama fenders, are suitable to provide the additional water plane area required to maintain hydrostatic stability.

Referring again to FIG. 1, it will be observed that before the hull 12 is ballasted down to the point where the pontoons 18 are submerged, the buoys 34 rest on top of the pontoons 18. Environmental conditions, such as rough seas, at the installation site may present additional difficulties when ballasting down the platform 10. Rough seas may cause the buoys 34 to repeatedly hit the pontoons 18 due to wave action as they submerge below the water line 16. To ameliorate this condition, a lift line 40 may be connected to an end of the buoy support frame 38 for pulling the buoy assembly to a controlled position off and above the pontoons 18. A linkage assembly, formed by a tri-plate 41 and linkage lines 43, connects the lift line 40 to padeyes and shackle and pin connectors 45 secured to the buoy support frame 38. The lift line 40 passes over a sheave 42 mounted on the deck 14 and the opposite end thereof is attached to a winch 44 mounted on top of the central column 13 of the hull 12. In such a configuration, the winch 44 is operated as needed to lift the buoys 34 upwardly and off the pontoons 18 as the platform 10 is ballasted down. As the platform 10 is lowered to its full installation draft, the buoys 34 pivot to a substantially vertical orientation and provide the necessary distributed buoyancy to maintain the hydrostatic stability of the platform 10.

As the hull 12 is ballasted down and after the floodable hard tank 28 is immersed (after the assembly of buoys 34 is pulled up with the lift line 40), but before the first buoy 34 starts to submerge, a "buoyancy gap" may occur. To minimize the effect of such a buoyancy gap, the buoy support frame 38 is connected to the buoy support post 36 by a synthetic rope 37, shown in FIG. 4, which is specified as short as possible. Alternatively, a short bar with a swivel on both ends may be substituted for the synthetic rope 37.

Upon reaching the installation draft of the platform 10, the tendons 20 are connected to the pontoons 18 and the platform 10 is deballasted to develop the tendon pre-tension required to provide stability to the platform 10. The secondary buoyancy assemblies mounted on the distal ends of the pontoons 18 are then filled with seawater and detached from the ends of the pontoons 18 and removed from the platform 10.

Figure 6:
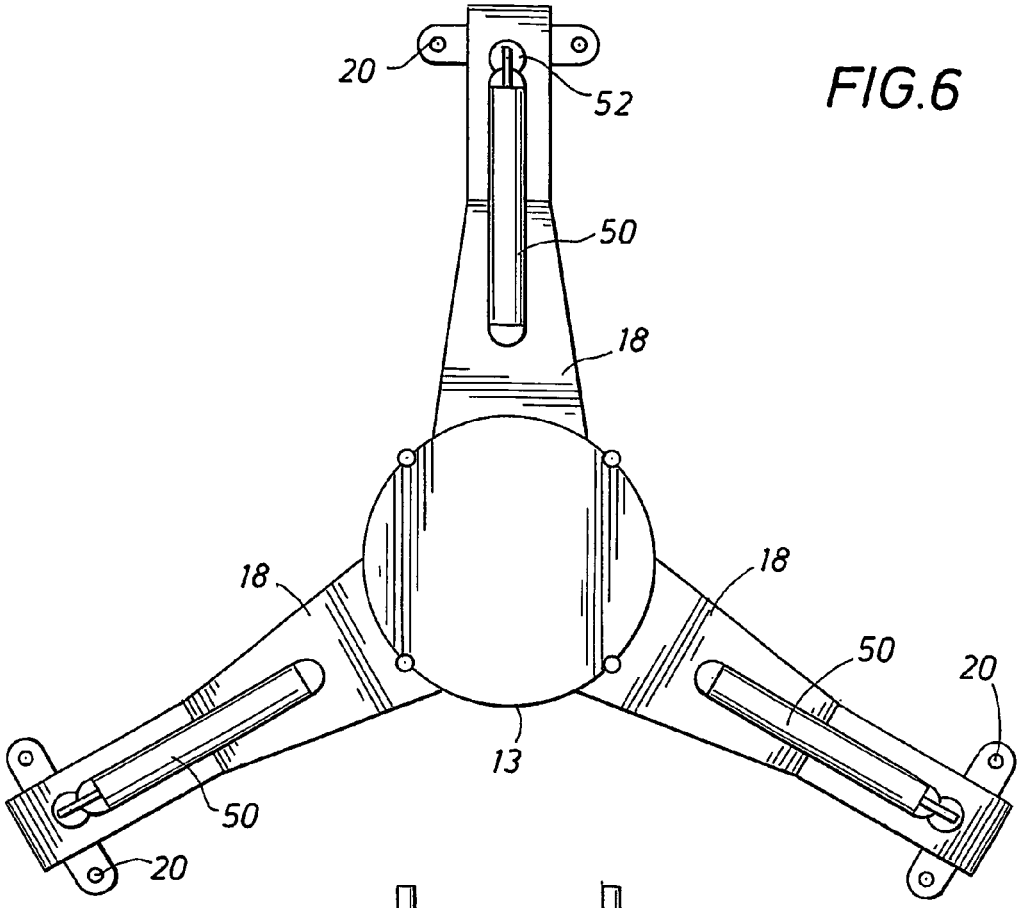
FIG. 6 is a top plan view of the floating platform of the invention depicting an alternate embodiment of a supplemental ballast means of the invention.
Figure 7:
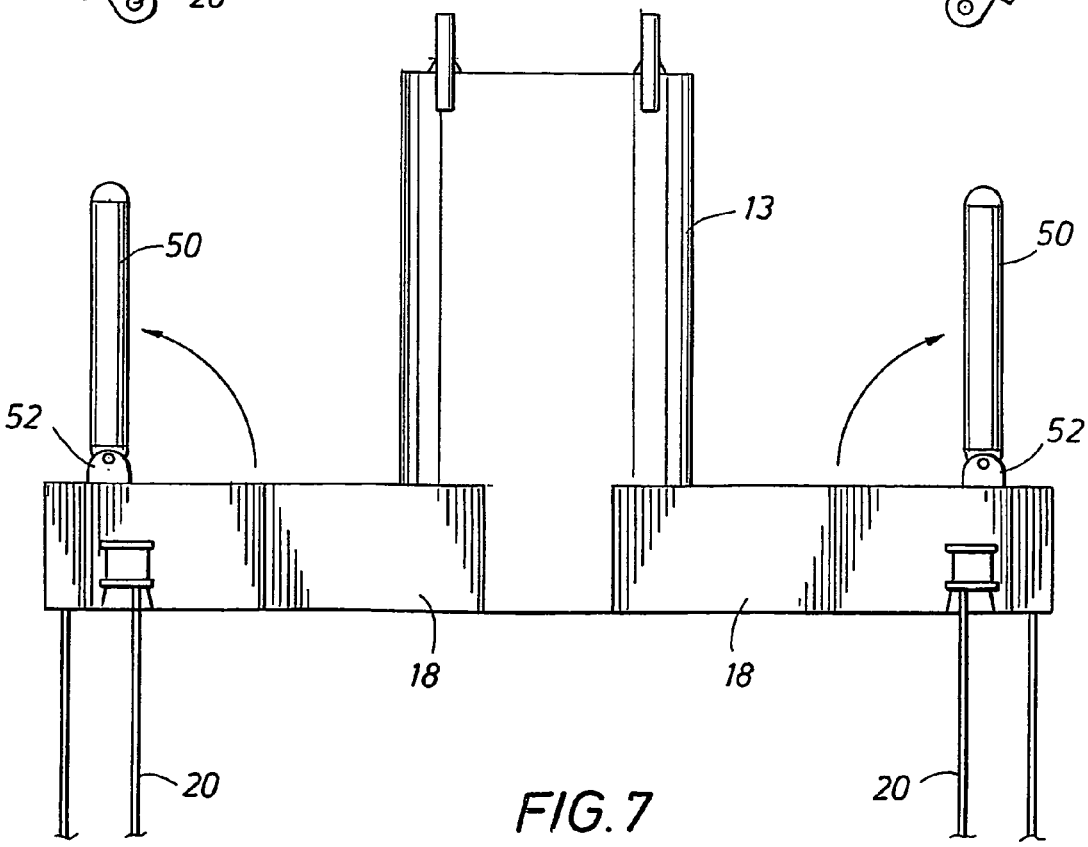
FIG. 7 is a side view of the floating platform of the invention shown in FIG. 6.

Referring now to FIGS. 6 and 7, an alternate embodiment of the platform 10 of the invention is shown. In the alternate embodiment of the invention, the secondary ballast assemblies are permanently secured to the pontoons 18. The secondary ballast assemblies comprise elongated buoys 50 pivotally connected to brackets 52 welded or otherwise secured to the top surfaces of the pontoons 18 near the distal ends thereof. The buoys 50 include the necessary plumbing, including a fill port and vent, for connection with the ballast system of the marine platform installation equipment. The buoys 50 operate similar to the buoys 34 previously described herein. As the platform 10 is ballasted to its installation draft, the buoys 50 are drawn into the water and float upwardly to a vertical orientation to provide the necessary water plane area for maintaining the hydrostatic stability of the platform 10. This alternate embodiment of the invention may also include the lift line and winch option to control slamming of the buoys 50 on the pontoons 18 in heavy seas.

While a preferred embodiment of the invention has been shown and described, other and further embodiments of the invention may be devised without departing from the basic scope thereof, and the scope thereof is determined by the claims which follow.

The invention claimed is:

1. A floating platform comprising a hull having an upper end extending above the water line, a deck supported above the water line on said upper end of said hull, at least three buoyant pontoons connected to a lower end of said hull and extending radially outwardly therefrom, the improvement comprising buoyancy means secured proximate the distal ends of said pontoons for maintaining the hydrostatic stability of said platform during transportation and installation.

2. The platform of claim 1 wherein said buoyancy means comprises a floodable tank mounted on the distal ends of said pontoons and a buoy assembly pivotally connected to said floodable tank.

3. The platform of claim 1 wherein said buoyancy means is detachably connected to said pontoons.

4. The platform of claim 2 including a winch and lift line operatively connected to said buoy assembly for lifting an end of said buoy assembly upwardly above said pontoons.

5. The platform of claim 1 wherein said buoyancy means comprise elongated buoys pivotally connected to said pontoons.

6. The platform of claim 1 including a winch and lift line operatively connected to said buoyancy means for lifting an end thereof upwardly above said pontoons.

7. A method of installing a floating platform, comprising the steps of:

a) wet towing said platform to an installation site wherein said platform includes a hull having at least three buoyant pontoons connected to a lower end of said hull and extending radially outwardly therefrom;

b) ballasting down said platform to an installation draft without the use of a derrick barge;

c) providing buoyancy means secured proximate the distal ends of said pontoons for maintaining the hydrostatic stability of said platform while ballasting down to the installation draft of said platform; and d) connecting said platform to anchor means for securing said platform at the installation site.

8. The method of claim 7 including providing a winch and lift line operatively connected to said buoyancy means for lifting an end thereof upwardly while ballasting down said platform to the installation draft of said platform.

9. The method of claim 7 including removing said buoyancy means from said platform after securing said platform to said anchor means.

10. A floating platform comprising:

a) a hull supporting one or more decks in a body of water above the water line;

b) said hull including buoyancy means for supporting said one or more decks of said platform above the water line, said buoyancy means including pontoons extending radially outwardly from a lower end of said hull; and c) supplemental buoyancy means secured on the distal ends of said pontoons for stabilizing said platform while ballasting down to the installation draft of said platform.

11. The platform of claim 10 wherein said supplemental buoyancy means comprises a floodable tank mounted on the distal ends of said pontoons and a buoy assembly pivotally connected to said floodable tank.

12. The platform of claim 10 wherein said supplemental buoyancy means is detachably connected to said pontoons.

13. The platform of claim 11 including a winch and lift line operatively connected to said buoy assembly for lifting an end of said buoy assembly upwardly above said pontoons.

14. The platform of claim 10 wherein said supplemental buoyancy means comprise elongated buoys pivotally connected to said pontoons.

15. The platform of claim 10 including a winch and lift line operatively connected to said supplemental buoyancy means for lifting an end thereof upwardly above said pontoons.

* * * * *